US006937933B1

(12) United States Patent
Jautelat et al.

(10) Patent No.: US 6,937,933 B1
(45) **Date of Patent: *Aug. 30, 2005**

(54) DEVICE AND METHOD OF CONTROLLING A DRIVE UNIT

(75) Inventors: Ruediger Jautelat, Bietigheim-Bissingen (DE); Rainer Sommer, Stuttgart (DE); Taskin Ege, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 124 days.

This patent is subject to a terminal disclaimer.

(21) Appl. No.: 10/089,620

(22) PCT Filed: Aug. 2, 2000

(86) PCT No.: PCT/DE00/02546

§ 371 (c)(1),
(2), (4) Date: Jul. 24, 2002

(87) PCT Pub. No.: WO01/23737

PCT Pub. Date: Apr. 5, 2001

(30) Foreign Application Priority Data

Sep. 30, 1999 (DE) ..... 199 47 252

(51) Int. Cl.[7] ..... G06F 19/00; G06G 7/70

(52) U.S. Cl. ..... 701/114; 701/1; 701/102; 701/96; 123/479; 123/489; 123/480

(58) Field of Search ..... 701/1, 96, 101, 701/102, 114; 123/489, 480, 479, 486, 488

(56) References Cited

U.S. PATENT DOCUMENTS 3,875,390 A 4/1975 Eccles et al. ..... 235/153
4,532,594 A 7/1985 Hosaka et al. ..... 364/431.11
5,050,562 A * 9/1991 Ishii et al. ..... 123/406.44
5,775,296 A * 7/1998 Goras et al. ..... 123/406.47
6,516,265 B1 * 2/2003 Sommer et al. ..... 701/115
2003/0158634 A1 * 8/2003 Hellmann et al. ..... 701/1

FOREIGN PATENT DOCUMENTS

DE 35 39 407 5/1987
DE 42 31 449 3/1994

OTHER PUBLICATIONS

S. Storandt et al., "Sichere und Fehlertolerante Mikrocontroller–Systeme", *Elektronik*, vol. 38, No. 10, 88–90, May 12, 1989.*

* cited by examiner

*Primary Examiner*—Willis R. Wolfe
*Assistant Examiner*—Johnny H. Hoang
(74) *Attorney, Agent, or Firm*—Kenyon & Kenyon

(57) ABSTRACT

A method and a device for controlling a drive unit, in particular, of an internal combustion engine in a vehicle, in which at least one performance quantity of the drive unit is detected and at least one actuator of the drive unit is controlled with controlled variables, depending on this performance quantity, according to predefinable or preselectable functionalities. In a controller, at least two processors process the possible functionalities, where these functionalities are defined by program code in at least one assigned program memory per processor. These possible functionalities of the processors, i.e., the program codes in the program memories assigned to the processors are identical.

15 Claims, 3 Drawing Sheets

DEVICE AND METHOD OF CONTROLLING A DRIVE UNIT

FIELD OF THE INVENTION

The present invention relates to a device and a method of controlling a drive unit, in particular, an internal combustion engine in a vehicle.

BACKGROUND INFORMATION

German Published Patent Application No. 42 31 449 discusses a device for controlling the drive power of an engine having at least two control units, a first control unit being connected to a first group of measuring devices and a second control unit being connected to a second group of measuring devices of the same measuring element. There may be special advantages of an engine which has two independent cylinder blocks and is controlled by two control units or controllers. Due to the fact that multiple control units are connected to only one measuring element for detection of the performance quantity, a high availability and operating reliability may be guaranteed. The system presented here having two control units has an asymmetrical functionality and program code and originally has a main computer, which is heavily utilized, and an emergency computer, which is only lightly utilized. Individual functions of the main computer are shifted to the emergency computer to optimize computation time and memory.

Instead of two controllers, German Published Patent Application No. 35 39 407 discusses a computer system having two processors for regulating characteristic quantities of an internal combustion engine. The two processors share the computer load in normal operation, each of the two processors being able to maintain emergency operation as an emergency computer in the event of malfunction. Thus, only the functions needed in emergency operation are implemented on both processors. However, in emergency operation these functions have a reduced extent of performance and function in comparison with normal operation. Due to this increased redundancy and division of work in normal computer operation, which is possible as part of the emergency function, reliability and operating speed may be increased.

Due to the asymmetrical division of functions of each controller or processor, the respective functionality must be defined, implemented, documented, tested, and maintained separately. Likewise, both controllers or computers must be equipped in the development stage with expensive measuring arrangements and/or emulation arrangements. Due to the asymmetrical definition of the functionality and therefore the asymmetrical definition of the systems, additional errors may occur due to a mix-up during assembly of the components, for example. At the same time, a further development of or change in functionality in the existing system requires that both controllers or computers and their respective functionalities be taken into account, which consequently is very complicated, time consuming and cost intensive.

This results in the object of implementing an engine control system having a very high functionality which is optimized with respect to other prior systems.

SUMMARY OF THE INVENTION

A control system of a drive unit, in particular, of an internal combustion engine including a control unit where the control unit contains at least two computers, is described. The functionality of the control unit or controller, too complex for one computer, may be divided among at least two computers in one controller. The program memories of the two computers or computing units contain the same program code, so that both computers may have an identical possible functionality. Thus the individual functionalities may be selectable to be less complex than the required overall functionality, so that the complex overall functionality may nevertheless be obtained via all computers or processors. In use, largely the same program code may be run through, although there may be individual parts that are present in both memories or computers but are processed asymmetrically, i.e., only in or from one memory.

The functions may be divided among more than two computers, or additional computers may be present in the overall system, although they execute a different program code, i.e., they have a different functionality. The computers may then be appropriately accommodated in different controllers.

The two computers having identical possible functionalities may appropriately exchange information, e.g., over a serial or parallel bus system such as a CAN bus or other serial interfaces or a DPRAM. It may be advantageous that the functionality need only be defined, implemented, documented, tested and maintained once due to the symmetrical division of function and the identical functionalities, but it may be used for both computers or computer units.

In manufacturing the controller, e.g., in prototype building or in production, the program memory which contains the program code and thus the functionality may be assembled twice in the controller, so there may be no possibility of mix-ups.

In the development and application phase, one may appropriately concentrate on one of the symmetrical sides. It may be sufficient to equip one side with expensive measuring arrangements or emulation devices. Due to the symmetrical division of functions and the symmetrical functionality on both computers, a modular design of the controller and the controller program may be possible. This makes further developments through changes in existing functions and/or introduction of new functions much easier and faster in comparison with an asymmetrical structure because there may be no interface problems or timing problems between the functions distributed among the computers. This results in lower development costs and shorter development times.

The main point is thus the symmetry and functionality of the computer system and the use of program memories including a completely identical program code for the at least two computers or computing units in the controller.

The present invention is described in greater detail below on the basis of the exemplary embodiments illustrated in the drawings.

DETAILED DESCRIPTION

Figure 1:
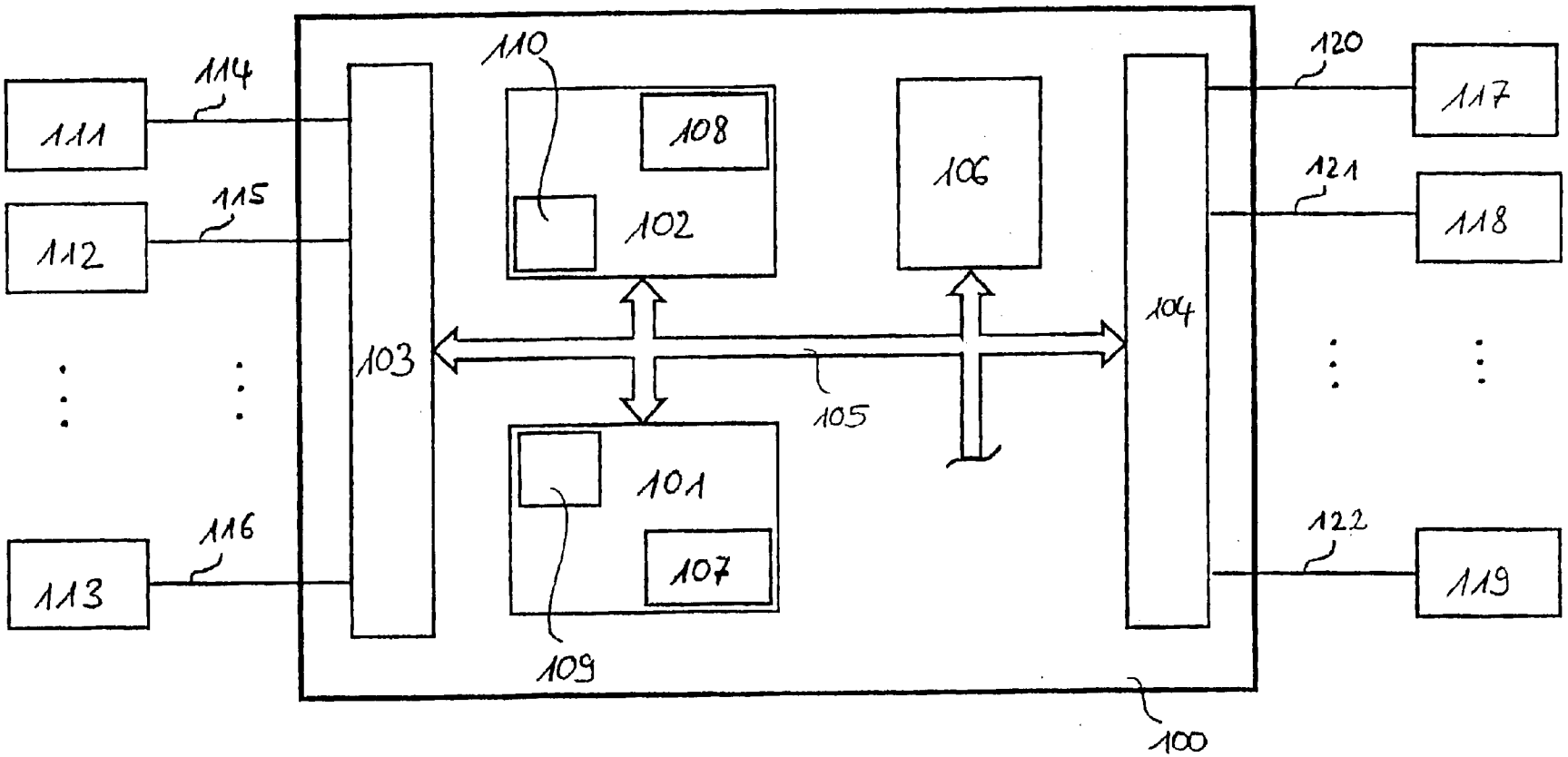
FIG. 1 shows a block diagram of a control unit including two computing elements or computers which control at least one performance quantity in the vehicle, for example the performance of a drive unit, in particular, of an internal combustion engine.

FIG. 1 shows an electronic controller 100, which includes at least two computers 101 and 102, an input module 103, an output module 104 and a bus system 105. Other components and/or modules may optionally be connected to bus system 105 as indicated by element 106. These additional optional elements include, for example, additional memory elements and/or an additional bus input/output interface, e.g., for diagnosis or for connection of controller 100 to other controllers. Input module 103 may be combined with output module 104 as well as the input/output module. Computer 101 contains, among other things, a processor 109 and a program memory 107 assigned to this processor 109. The program code filed in program memory 107 corresponds to the possible functionality with regard to the control or regulation of at least one performance quantity such as that it may be processable by processor 109. It may be advantageous for the reasons given above if first computer 101 and second computer 102 have a completely identical design, likewise with a processor 110 and a program memory 108 allocated to them. However, different computers may optionally also be used as long as the possible functionality of both computing units is identical. Input module 103 receives signals which represent measured performance quantities of the drive unit, the drive train and/or the vehicle or from which such performance quantities may be derived. These may be performance quantities which may be analyzed to control an internal combustion engine. These signals may be picked up by measuring devices 111 through 113, in particular, sensors, and may be sent to input module 103 via input lines 114 through 116.

Furthermore, signals which actuate control elements or actuators for setting at least one performance quantity of the drive unit, in particular, the internal combustion engine of the vehicle, may be output via output module 104. The corresponding signals for controlling actuators 117 through 119 may be delivered via output lines 120 through 122. Depending on the input signals, performance quantities and/or internal quantities derived from them, computers 101 and 102 form values for the controlled variables which may be output and which set the control elements in the sense of a predetermined control or regulatory strategy as part of the programs implemented therein. Controller 100 may be a control unit for controlling a drive unit, in particular, of an internal combustion engine, of a vehicle, so the position of an operating element that may be operated by the driver may be detected and analyzed in a known way and a setpoint value for a torque of the drive unit may be determined. A setpoint value for the torque may then be determined by taking into account setpoint values of other control systems received over input module 103, e.g., a traction control, a transmission control, etc., as well as setpoint values formed internally (limits, etc.). Then in an exemplary embodiment of an internal combustion engine control system, this may be converted to a setpoint value for setting the throttle valve, which may be set as part of a position control loop. Furthermore, depending on the design of the internal combustion engine, additional performance-determining functions may be provided, e.g., a control for a turbo charger of an exhaust gas recycling system, an idling speed regulation, etc.

In addition, with internal combustion engines having direct gasoline injection, not only the air setting but also the determination of the fuel mass to be injected, the determination of an air/fuel ratio to be set, the preselection of the injection course (pre-injection, post-injection), the control of a charge movement valve, etc., have a crucial effect on performance, so that, in addition to the programs described there, a plurality of other programs may be provided which have an influence on the performance of the internal combustion engine and thus on the safety of the vehicle.

This plurality of programs may be filed or may be installed in the form of a program code in respective program memories 107 and 108 of the computer. The functionalities of a controller represented by the programs or program code in the program memory as described here may be very complex. Therefore, these complex functionalities of the controller should be divided symmetrically between at least two computers in such a controller. The computers may exchange information, e.g., over a communication system, in particular a bus system such as a CAN bus or another serial or parallel interface or a memory element, in particular, a DPRAM. Program memories 107 and 108 of two computers 101 and 102 contain the same program code. In addition, the identical program code may be executed to a great extent, but there may be individual parts which, for some reason, are processed asymmetrically. For example, the required programs or sections to be processed asymmetrically may then be activated or deactivated via hardware lines and signals transmitted on them. For the sake of simplicity of the diagram, these line connections may be represented by communication system 105 and/or may be integrated into it.

Figure 2:
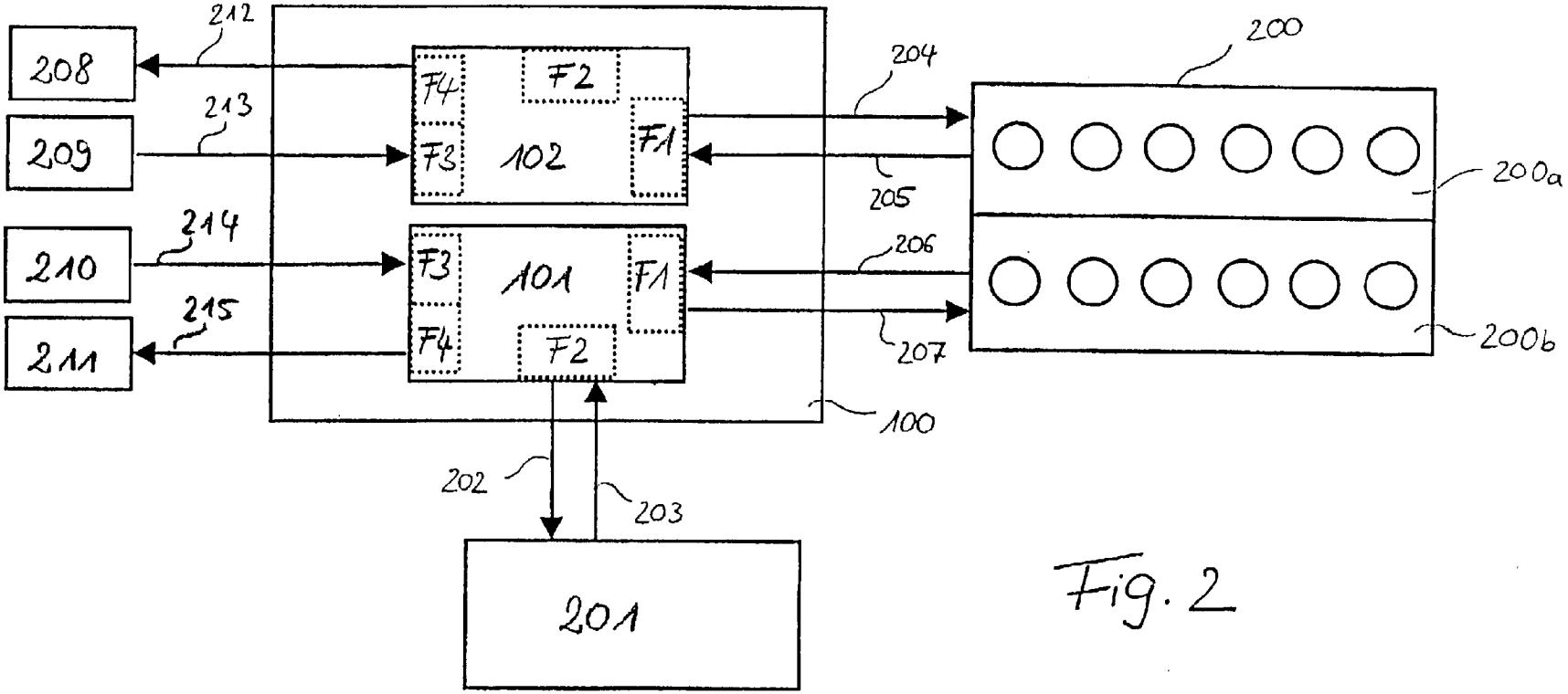
FIG. 2 illustrates functional relationships between the two computers in the controller and their environment.

The procedure described above is illustrated in FIG. 2 with regard to a division of functions F1 through F4 as an example. The controller is again labeled as 100, and the two computers are labeled as 101 and 102. An internal combustion engine including the respective actuators and sensors is labeled as 200. This specific example shows an internal combustion engine including 12 cylinders divided into two cylinder blocks of six cylinders each. The 12 cylinders are only an example, and it may be equally possible for a different number of cylinders to be provided in respective cylinder blocks 200*a* and 200*b*, each including the respective sensors and other actuators. Thus, in a 12-cylinder engine, for example, six cylinders may be operated by each computer with regard to ignition and injection in a gasoline engine. The functionality may be distributed symmetrically among the two computers. Functionality F1 controls one cylinder block with the respective sensors and actuators of the internal combustion engine. Sensor quantities such as the air/fuel ratio, the camshaft or crankshaft position, knocking information, air mass, etc. from internal combustion engine 200 may be sent to computers 101 and 102, in particular, their functionality F1 (205, 206). Actuating signals (204, 207) from functionality F1 reach the internal combustion engine or its actuators. Oriented connections 204 through 207 represent the functionality of the transmission per se. Circuit parts or sensors may be used via both processors. For example, the sensor, e.g., a hot film air mass flow sensor and an input circuit, e.g., a low-pass filter, may be present only once for cost reasons, but the sensor signal, e.g., an A/D-converted air flow, may be available to the functionalities in both computers.

Likewise, a controller, e.g., a secondary air pump including the corresponding output stage in the controller may be operated by only one computer, whereas the respective engine function, e.g., the secondary air control including diagnosis, runs symmetrically in both computers and also supplies quantities for other engine functions.

In addition, actuators such as secondary air valve for a first cylinder block may be operated by the computer for the other cylinder block, namely the second, although the respective engine function may be running in the computer for the first cylinder block.

The program code for operation of the actuator, e.g., for regulating the position of the throttle valve, may run symmetrically in both computers, in which case, however, the output stage and the actuator may be operated on one cylinder block, but on the other cylinder block the signal from the computer may be not used for control purposes.

Due to the exemplary embodiments described above as well as the following description of the tank system, despite the identity of the functionalities and the program code, certain asymmetries may be provided.

Additional peripherals such as a tank system 201 may be controlled and monitored by another functionality F2. This functionality F2 may be likewise contained symmetrically in both computers 101 and 102. However, it may be processed only asymmetrically by computer 101, for example. Therefore, this functionality F2 may be activated or deactivated by signals of separate hardware lines or by unambiguous signals or data over the communication system. Thus, if there is only one tank in the vehicle, diagnosis of the tank is performed in only one computer. Although corresponding functionality F2 is present on both computers in the program memory, it is activated on only one side. The communication relationship between functionality F2 in computer 101 and tank system 201 may be represented by connections 202 and 203.

In addition, functionalities F3 and F4 may also be provided for other peripheral elements, so that, on one hand, sensor elements 209 and 210 may be input and processed via communication link 213 and 214 (F3). On the other hand, control elements, actuators 208 and 211 may also be operated via communication links 212 and 215 by functionalities F4. Likewise, quantities to or from other control systems such as a traction control, a transmission control, etc. may be relayed via oriented connections 212 through 215. If sensor element 209 and control element 208 are elements of the same control loop, functionalities F3 and F4 may also be considered together as functionality F34.

Figure 3:
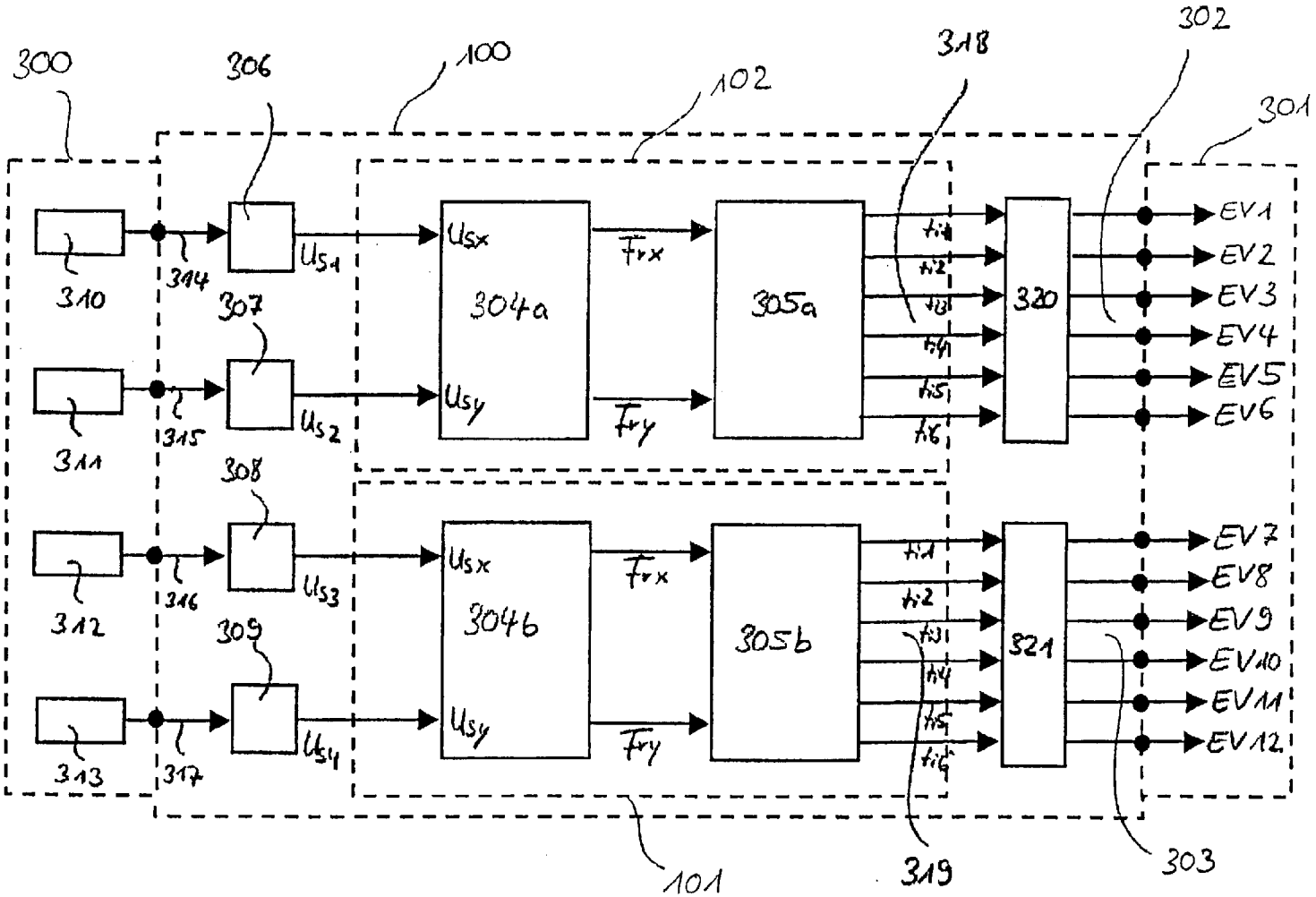
FIG. 3 shows the exemplary embodiment with functional relationships based on lambda regulation for calculation of injection in the internal combustion engine.

FIG. 3 shows an exemplary embodiment of a 12-cylinder engine having a concrete functionality. Thus, this 12-cylinder engine may have four parallel exhaust gas lines, for example, including four regulating probes 310 through 313, combined as lambda probes 300. Thus a quadro lambda regulation would have to be provided in the engine control unit, but because of its high complexity this entails not only increased costs but also risks with regard to malfunctions, in particular, security risks. Due to the symmetrical division of functions between two computers, there may be only one stereo-lambda regulation in each computer 101 or 102 in controller 100, i.e., the functionality may be far less complex. The signals supplied by probes 310 through 313 go via interfaces 314 through 317 for hardware processing. This signal processing takes place through elements 308 and 309 for computer 101 and through elements 306 and 307 for computer 102. Probe signals US1 and US2 may be sent to computer 102, and probe signals US3 and US4 may be sent to computer 101.

Thus only two probe signals may be analyzed in each computer, and the lambda regulation factors act, as explained later, only on six injectors via the injection calculation. Then, as stated previously, the same-stereo lambda regulation may be performed in block 304*a* and 304*b*. To do so, processed probe signals US1 and US2 enter the regulation as probe signals USX and USY. Likewise, processed probe signals US3 and US4 in block 304*b* also enter as USX and USY into the same stereo-lambda regulation. Regulating factors FRX and FRY that are obtained from the stereo-lambda regulation may be relayed to downstream blocks 305*a* and 305*b* for computer 102 and computer 101, respectively.

Based on regulation factors FRX and FRY, the same injection calculation may then be performed in blocks 305*a* and 305*b* for six injectors in this exemplary embodiment. The resulting output quantity groups 318 and 319 may then be relayed to output stage blocks 320 and 321.

On the basis of the same program code or the identical functionalities, the function blocks are also identical. Likewise, input quantities, output quantities and state variables of computers 101 and 102 have identical designations. Output quantities 318 and 319 are equally designated as ti1 through ti6, although they have physically different meanings. Thus, ti1 may be used once for controlling injector 1, EV1, and once for controlling injector 7, EV7. However, this has no relevance for the function or functionality or the program code. Injectors 301 may then be controlled via interface 302 or 303 from output stage blocks 320 and 321.

The symmetrical distribution of functions discussed above is illustrated in FIGS. 1, 2 and 3, although parts may be processed asymmetrically. Nevertheless, the functionality and the program code are identical for both computers and are run through in both computers independently of one another. There is no redundancy and there are no emergency operating properties in sensors, output stages or functionality. Such a redundancy would have to be generated additionally, independently of the exemplary embodiments according to the present invention.

What is claimed is:

1. A device for controlling a drive unit, the drive unit being of an internal combustion engine in a vehicle, the device comprising:

at least one sensor;

at least one actuator;

a controller; and at least two processors that exchange information between each other in a non-hierarchical manner;

wherein at least one program memory contains program code and is assigned to each of the at least two processors, and the program code in the at least two program memories is identical.

2. The device of claim 1, wherein the at least one sensor is connected to a first processor, and the at least one actuator is connected to one of the first processor and at least one second processor, the processors also being connected.

3. The device of claim 1, wherein there are at least two sensors and at least two actuators, and each sensor and each actuator is assigned to one of the at least two processors and the at least one program memory assigned to it.

4. A control unit for controlling a drive unit, the drive unit being of an internal combustion engine in a vehicle, the control unit comprising:

at least two processors that exchange information between each other in a non-hierarchical manner; and at least one program memory containing program code assigned to each of the at least two processors, the program code being identical in the at least two program memories.

5. A method for controlling a drive unit, the drive unit being of an internal combustion engine in a vehicle, the method comprising:

determining at least one performance quantity of the drive unit;

controlling, as a function of the at least one performance quantity, at least one actuator of the drive according to at least one of predefinable and selectable functionalities using controlled variables;

processing, in at least one controller by at least two processors that exchange information between each other in a non-hierarchical manner, the possible functionalities, wherein the functionalities are predefined by program code in at least one program memory assigned to each of the at least two processors, and the functionalities per processor and the program codes are identical in the program memories assigned to the at least two processors.

6. The method of claim 5, wherein the at least one performance quantity is processed in a first processor, and the at least one actuator is controlled with at least one controlled variable from one of the first processor and at least one second processor.

7. The method of claim 5, wherein a distinction is made between performance quantities of a first type and of a second type, the performance quantities of the first type being processed in the functionalities of the at least two processors, and the performance quantities of the second type being processed only in the functionalities of one of the at least two processors.

8. The method of claim 7, wherein a distinction is made between controlled variables of the first type and controlled variables of the second type, the controlled variables of the first type being formed by the functionalities of a first processor from the performance quantities which are processed in the functionalities of a first processor, and the controlled variables of the second type being formed by the functionalities of the first processor from the performance quantities which are processed in the functionalities of a second processor, and the functionalities of the at least two processors exchange information.

9. The device of claim 1, further comprising:

an input module to receive a signal from the at least one sensor and to provide the signal to the at least two processors.

10. The device of claim 9, wherein the input module is configured to receive input from a traction control element.

11. The device of claim 9, wherein the input module is configured to receive input from a transmission control element.

12. The device of claim 1, wherein the program code includes code to determine a setpoint value for a torque of the drive unit.

13. The device of claim 1, wherein the program code includes code to control a turbo charger of an exhaust gas recycling system.

14. The device of claim 1, wherein the program code includes code to perform a stereo-lambda regulation.

15. The device of claim 1, wherein the at least two processors are configured to perform non-redundant functionalities.

* * * * *